US005862873A

United States Patent [19]

Matthias et al.

[11] Patent Number: 5,862,873

[45] Date of Patent: Jan. 26, 1999

[54] ELEMENTS FACED WITH SUPERHARD MATERIAL

[75] Inventors: Terry R. Matthias, Longlevens, England; Alex Newton, Houston; Daniel J. Sarik, Katy, both of Tex.

[73] Assignee: Camco Drilling Group Limited, England

[21] Appl. No.: 616,361

[22] Filed: Mar. 15, 1996

[30] Foreign Application Priority Data

Mar. 24, 1995 [GB] United Kingdom ..... 9506079

[51] Int. Cl.[6] ..... E21B 10/46

[52] U.S. Cl. ..... 175/432; 51/295

[58] Field of Search ..... 175/432, 428, 175/434, 429, 430, 431, 433; 51/293, 295, 297

[56] References Cited

U.S. PATENT DOCUMENTS

| | | | |
|---|---|---|---|
| 4,525,178 | 6/1985 | Hall | 51/309 |
| 4,529,048 | 7/1985 | Hall | 175/432 |
| 4,629,373 | 12/1986 | Hall | 175/434 |
| 4,784,023 | 11/1988 | Dennis | 76/108 A |
| 4,861,350 | 8/1989 | Phaal et al. | 51/307 |
| 5,011,516 | 4/1991 | Frushour | 51/307 |
| 5,120,327 | 6/1992 | Dennis | 51/293 |
| 5,351,772 | 10/1994 | Smith | 175/432 |
| 5,355,969 | 10/1994 | Hardy et al. | 175/432 |
| 5,469,927 | 11/1995 | Griffin | 175/432 |
| 5,564,511 | 10/1996 | Frushour | 175/431 |
| 5,590,728 | 1/1997 | Matthias et al. | 175/432 |
| 5,605,199 | 2/1997 | Newton | 175/432 |
| 5,622,233 | 4/1997 | Griffin | 175/432 |
| 5,662,720 | 9/1997 | O'Tighearnaigh | 51/295 |

FOREIGN PATENT DOCUMENTS

| | | |
|---|---|---|
| 0133386 | 2/1986 | European Pat. Off. . |
| 0389800 | 10/1990 | European Pat. Off. . |
| 0579376 | 1/1994 | European Pat. Off. . |
| 0601840 | 6/1994 | European Pat. Off. . |
| 0638383 | 2/1995 | European Pat. Off. . |
| 06911674A1 | 1/1996 | European Pat. Off. . |
| 2283772 | 5/1995 | United Kingdom . |
| 2283773 | 5/1995 | United Kingdom . |
| 2 290 570 | 1/1996 | United Kingdom . |

*Primary Examiner*—Hoang C. Dang
*Attorney, Agent, or Firm*—Fletcher, Yoder & Edwards

[57] ABSTRACT

A preform element, for example for use as a cutting element on a rotary drag-type drill bit, includes a facing table of superhard material having a front face and a rear face bonded to the front face of a substrate which is less hard than the superhard material. The rear face of the facing table comprises a surface formed with a plurality of spaced protuberances and a plurality of spaced sockets, and the front face of the substrate comprises a surface which is bonded to the surface of the facing table and is formed with a plurality of spaced protuberances which are bonded within said sockets in the facing table, and a plurality of spaced sockets within which are bonded said protuberances on the facing table.

33 Claims, 8 Drawing Sheets

Fig. 11
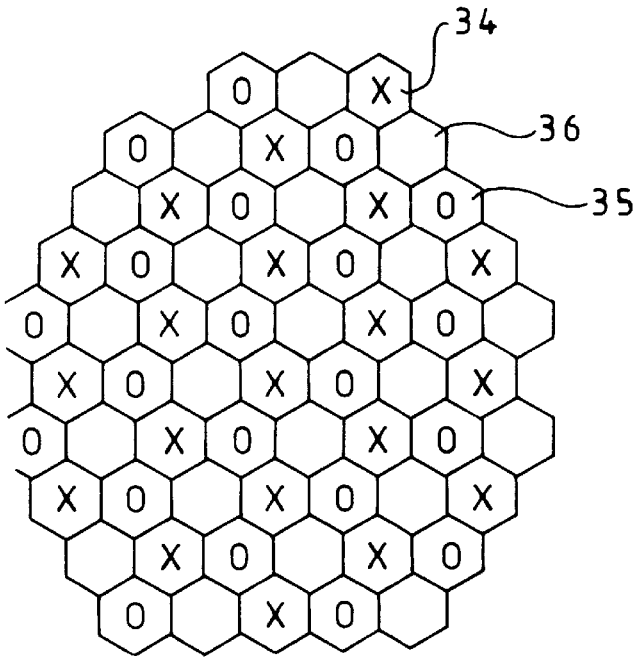
Fig. 12
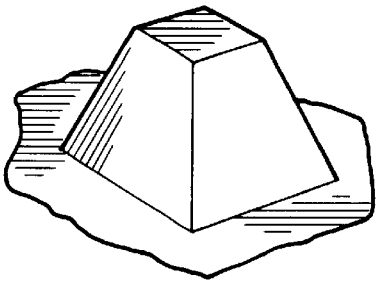
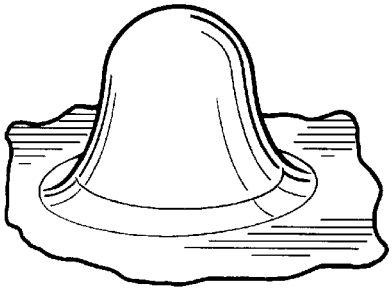
Fig. 13
Fig. 14
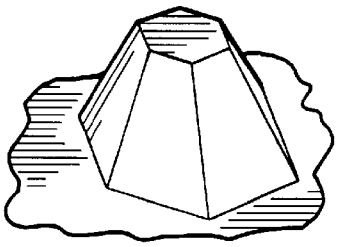

Fig. 15
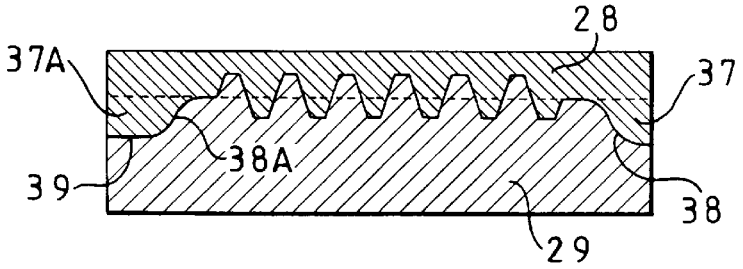
Fig. 16
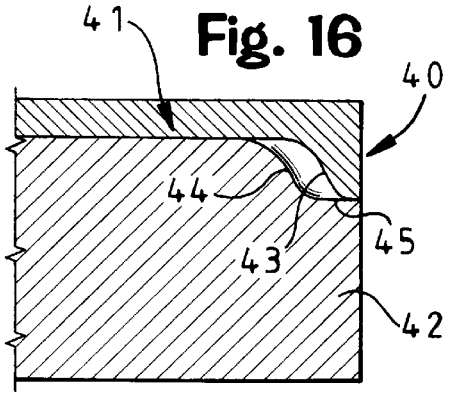
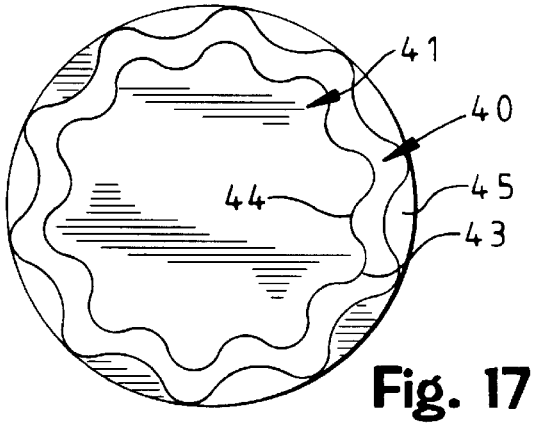
Fig. 17
Fig. 18
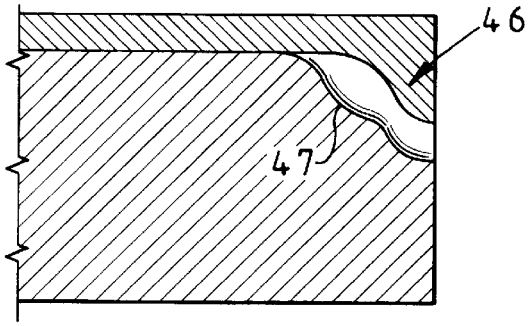
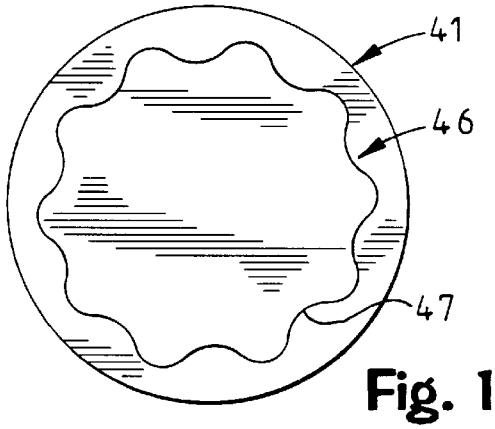
Fig. 19
Fig. 20
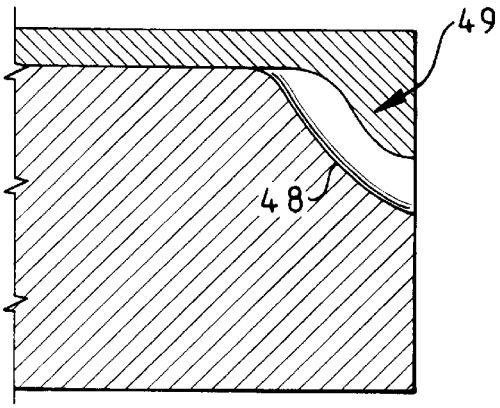
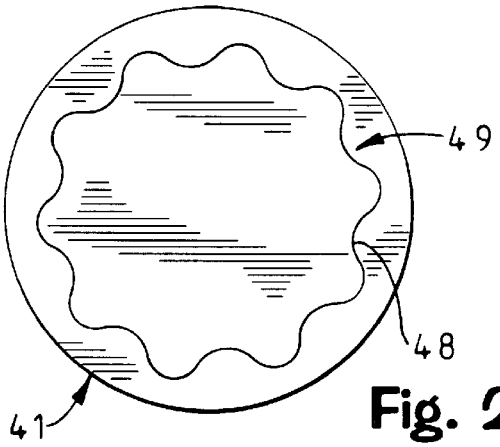
Fig. 21

Fig. 22
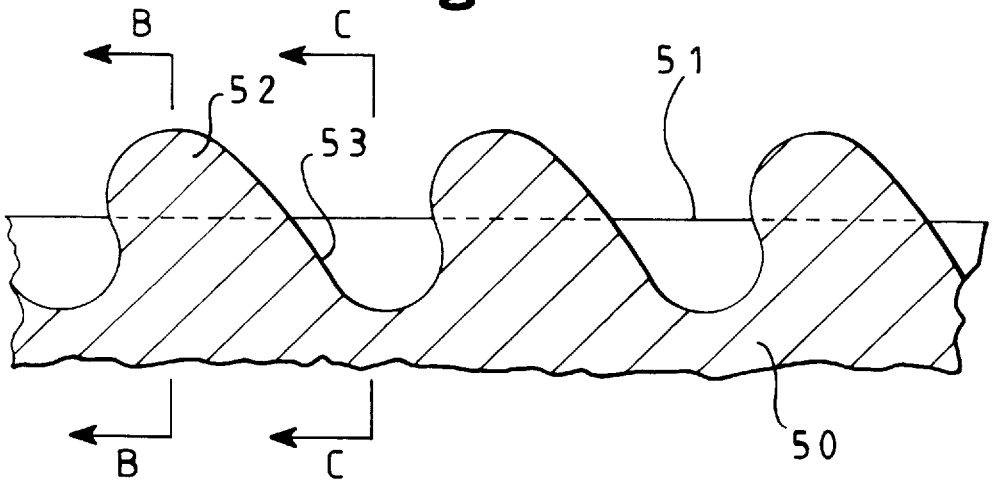
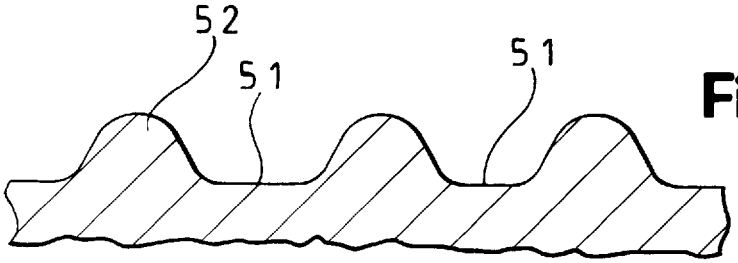
Fig. 23
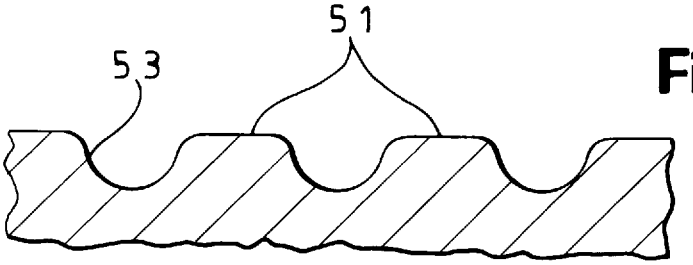
Fig. 24
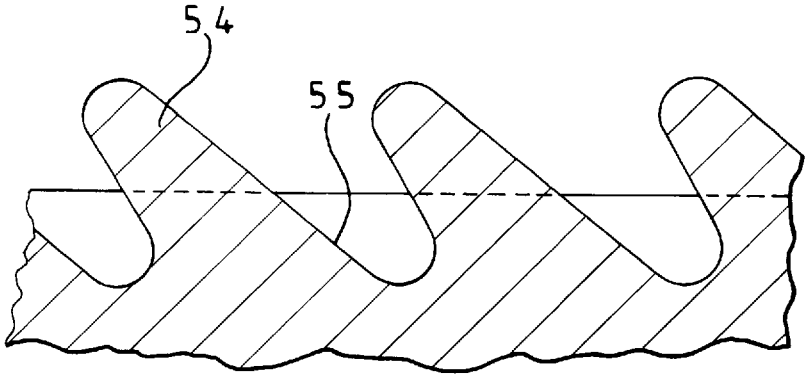
Fig. 25

ELEMENTS FACED WITH SUPERHARD MATERIAL

BACKGROUND OF THE INVENTION

1. Field of the Invention

The invention relates to elements faced with superhard material and, more particularly, to preform elements comprising a facing table of superhard material having a front face, a peripheral surface, and a rear surface bonded to a substrate of material which is less hard than the superhard material.

2. Description of Related Art

Preform elements of this kind are often used as cutting elements on rotary drag-type drill bits, and the present invention will be particularly described in relation to such use. However, the invention is not restricted to cutting elements for this particular use, and may relate to preform elements for other purposes, for example as cutters on roller cone and percussive (hammer) bits. Also, elements faced with superhard material, of the kind referred to, may also be employed in workpiece-shaping tools, high pressure nozzles, wire-drawing dies, bearings and other parts subject to sliding wear, as well as elements subject to percussive loads as may be the case in tappets, cams, cam followers, and similar devices in which a surface of high wear resistance is required.

Preform elements used as cutting elements in rotary drill bits usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a socket in the body of the drill bit. The carrier is often formed from cemented tungsten carbide, the surface of the substrate being brazed to a surface on the carrier, for example by a process known as "LS bonding". Alternatively, the substrate itself may be of sufficient thickness as to provide, in effect, a cylindrical stud which is sufficiently long to be directly received in a socket in the bit body, without being brazed to a carrier. The bit body itself may be machined from metal, usually steel, or may be molded using a powder metallurgy process.

Such cutting elements are subjected to extremes of pressure and temperature during formation, high temperature during mounting on the bit body, and are also subjected to high temperatures and heavy loads when the drill is in use down a borehole. It is found that as a result of such conditions spalling and delamination of the superhard facing table can occur, that is to say the separation and loss of the diamond or other superhard material over the cutting surface of the table. This may also occur in preform elements used for other purposes, and particularly where the elements are subjected to repetitive percussive loads, as in tappets and cam mechanisms.

Commonly, in preform elements of the above type the interface between the superhard table and the substrate has usually been flat and planar. However, particularly in cutting elements for drill bits, attempts have been made to improve the bond between the superhard facing table and the substrate by configuring the rear face of the facing table so as to provide a degree of mechanical interlocking between the facing table and substrate.

One such arrangement is shown in U.S. Pat. No. 5,120,327 where the rear surface of the facing table is integrally formed with a plurality of identical spaced apart parallel ribs of constant depth. The facing table also includes a peripheral ring of greater thickness, the extremities of the parallel ribs intersecting the surrounding ring. U.S. Pat. No. 4,784,023 illustrates a similar arrangement but without the peripheral ring.

British Patent Application No. 9422427.6 describes numerous types of preform element where the rear surface of the facing table is integrally formed with a plurality of ribs which project into the substrate and extend in directions outwardly away from an inner area of the facing table towards the peripheral surface of the table.

British Patent Application No. 9422426.8 describes arrangements where the rear surface of the facing table is integrally formed with a plurality of protuberances which project into the substrate, the depth to which at least certain of the protuberances project into the substrate varying in irregular manner across the facing table. The protuberances may themselves be irregular in size, shape and distribution over the facing table, or they may be arranged in more regular fashion, for example comprising ribs which are parallel or which extend outwardly from a central region of the facing table.

SUMMARY OF THE INVENTION

The present invention sets out to provide further novel designs of preform element having a non-planar interface between the facing table and substrate, and where the configuration of the interface achieves a redistribution and reduction of the interface stress between the facing table and the substrate. The arrangements according to the invention may also allow the minimization of those parts of the interface which are planar, and ensure that the stress imposed on the facing layer is a compressive stress. All these features combine to reduce spalling and delamination of the facing table.

According to the invention there is provided a preform element including a facing table of superhard material having a front face and a rear face bonded to the front face of a substrate which is less hard than the superhard material, the rear face of the facing table comprising a surface formed with a plurality of spaced protuberances and a plurality of spaced sockets, and the front face of the substrate comprising a surface which is bonded to the surface of the facing table and is formed with a plurality of spaced protuberances which are bonded within said sockets in the facing table, and a plurality of spaced sockets within which are bonded said protuberances on the facing table.

The surfaces formed with said protuberances and sockets may both be substantially flat, apart from said protuberances and sockets. Alternatively, the surfaces may comprise a convexly curved surface, on one of the facing table and substrate, bonded to a mating concavely curved surface on the other of the facing table and substrate. In either case the surfaces may not be perfectly flat or smoothly curved but may have regular or random fluctuations across the preform element.

In practice, the location of each said surface may be largely defined by the locations of the mouths of the sockets and the bases of the protuberances which extend from the surface, and the physical manifestation of the surface may be limited to small areas of the surface between said sockets and protuberances, the size of said remaining areas of the surface depending on the shape and spacing of the protuberances and sockets.

On each of said surfaces the protuberances and sockets are preferably arranged in substantially regular arrays. For example, the protuberances and sockets may each be arranged in substantially parallel rows. In this case each row of protuberances may be co-extensive with a row of sockets so that at least some of the sockets are located in the spaces between adjacent protuberances, and vice versa. For example, protuberances and sockets may be arranged alternately along each row.

The protuberances and sockets may be arranged in two sets of parallel rows, each set being at right angles to the other, or being inclined to the other at an angle which is less than a right angle. The individual protuberances and sockets may be tapered as they extend away from said surface. They may be of any cross-sectional shape, e.g. circular, square or hexagonal. For example each protuberance and socket may be generally frusto-conical or in the shape of a square or triangular pyramid, which may be truncated. Alternatively, each protuberance and socket may, as viewed in longitudinal cross-section, be in the shape of a portion of a generally sinusoidal curve.

The protuberances and sockets may be of substantially constant height over the facing table and substrate, or they may vary in height. For example, the extremities of the protuberances and sockets may lie on an imaginary surface within the facing table or substrate. The imaginary surface may be substantially flat or it may be convexly or concavely curved, or of any other suitable shape. In accordance with the teaching of British Application No. 9422426.8, the depths of the protuberances and sockets may vary irregularly, for example randomly, across the facing table or substrate so that a crack initiated at the extremity of one protuberance is likely to meet an adjacent protuberance as it extends through the material of the facing table or substrate, so that further development of the crack is in inhibited.

In any of the above arrangements the facing table may be formed with a thickened peripheral rim which projects into the substrate. Preferably the peripheral rim is smoothly curved, for example sinusoidally, as viewed in cross-section. The thickened peripheral rim may vary in width and/or depth as it extends around the periphery of the facing table.

In any of the above arrangements there may be provided a transition layer between the superhard material and the less hard material. As is well known, such transition layers normally comprise material having one or more properties, such as the coefficient of thermal expansion and/or elastic modules, which is intermediate the corresponding properties of the superhard and less hard materials.

The transmission layer may, for the purposes of the present invention, be regarded either as a part of the facing table or as a part of the substrate. Thus, the protuberances and sockets arranged according to the present invention may be provided at the interface between the superhard material and the transition layer, or between the transition layer and the less hard material, or at both said interfaces. The invention also includes within its scope arrangements where one of said interfaces is configured with protuberances and sockets in accordance with the present invention and the other interface is configured, so as to be non-planar, in a different manner.

Any of the facing table, the substrate, and the transition layer may comprise a plurality of different layers or portions bonded together and do not necessarily comprise a unitary body of material.

BRIEF DESCRIPTION OF THE DRAWINGS

FIGS. 8–11 are diagrammatic plan views of parts of alternative forms of substrate.

FIGS. 12–14 are diagrammatic perspective views of alternative shapes of protuberance or socket.

FIG. 15 is a diagrammatic cross-section through a preform cutting element showing another aspect of the present invention.

FIG. 16 is a half section through another form of preform cutting element.

FIG. 17 is a rear view of the facing table of the element shown in FIG. 16, the substrate being removed.

FIGS. 18, 19, 20 and 21 are similar views to FIGS. 16, 17 of alternative arrangements, FIG. 22 is a diagrammatic section of the substrate of a further form of preform cutting element in accordance with the present invention.

FIG. 23 is a section on the line B—B of FIG. 22.

FIG. 24 is a section along the line C—C of FIG. 22.

FIG. 25 is a similar view to FIG. 22 of an alternative configuration.

DETAILED DESCRIPTION OF THE PREFERRED EMBODIMENTS

Figure 1:
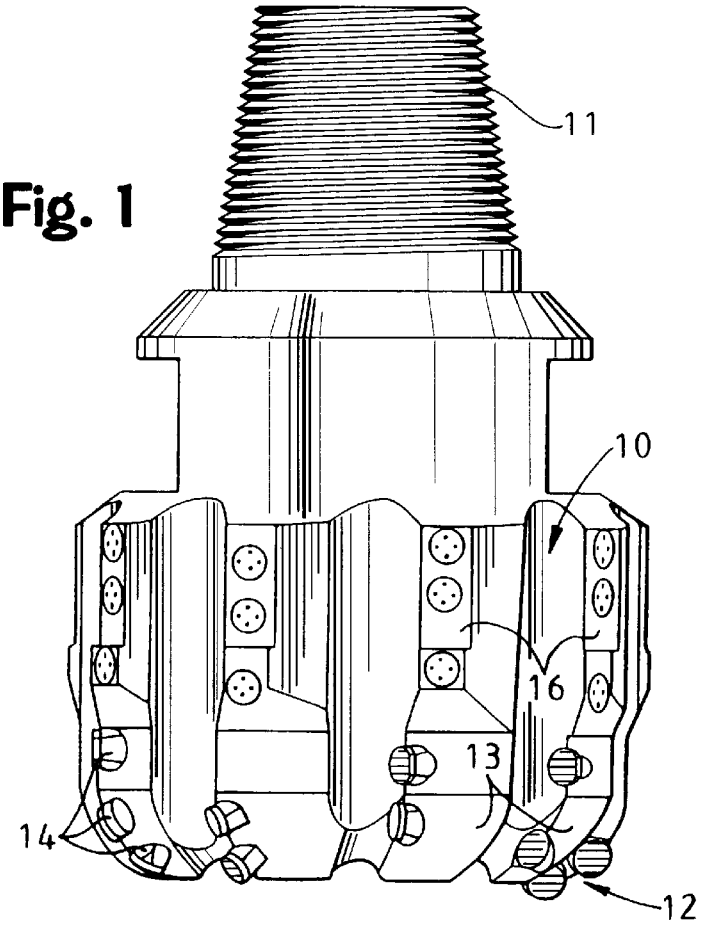
FIG. 1 is a side elevation of a typical drag-type drill bit in which preform cutting elements according to the present invention may be used.
Figure 2:
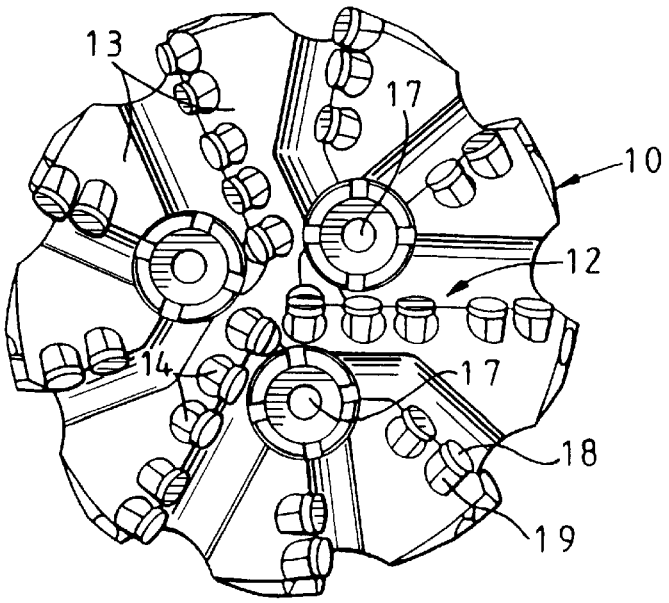
FIG. 2 is an end elevation of the drill bit shown in FIG. 1.

FIGS. 1 and 2 show a typical full bore drag-bit of a kind to which cutting elements of the present invention are applicable. The bit body 10 is machined from steel and has a shank formed with an externally threaded tapered pin 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilize the bit in the borehole. A central passage (not shown) in the bit and shank delivers drilling fluid through nozzles 17 in the end face 12 in known manner.

Each cutter assembly 14 comprises a preform cutting element 18 mounted on a carrier 19 in the form of a post which is located in a socket in the bit body. Each preform cutting element is in the form of a circular tablet comprising a facing table of superhard material, usually polycrystalline diamond, bonded to a substrate which is normally of cemented tungsten carbide. The rear surface of the substrate is bonded, for example by LS bonding, to a suitably orientated surface on the post 19.

Figure 3:
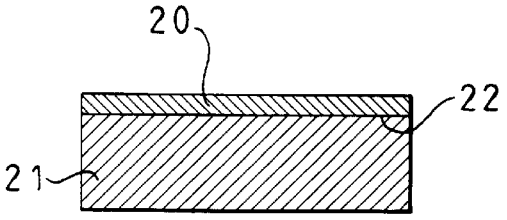
Fig. 3 ( Prior Art )
FIGS. 3 and 4 are cross-sections of prior art preform cutting elements.

A typical prior art preform cutting element is shown in section in FIG. 3. The cutting element is in the form of a circular tablet and comprises a polycrystalline diamond front facing table 20 bonded to a cemented tungsten carbide substrate 21. Both the facing table 20 and substrate 21 are of constant thickness and the interface 22 between them is flat. As is well known, the facing table and substrate are bonded together during formation of the element in a high pressure, high temperature forming press.

Figure 4:
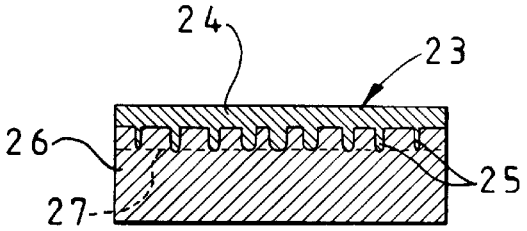
Fig. 4 ( Prior Art )

FIG. 4 shows another prior art cutting element of a kind designed to improve the bond between the facing table and substrate and to reduce the tendency for delamination to occur. In this case the facing table 23 comprises a flat front layer 24 of constant thickness which provides the front cutting face of the facing table. Integrally formed with the front layer 24 are a plurality of parallel spaced ribs 25 which project rearwardly from the front layer 24 and into the substrate 26. The ribs 25 are equally spaced apart and project into the substrate 26 to a uniform depth so that the rearward extremities of the ribs lie on an imaginary plane 28A which is flat.

Figure 5:
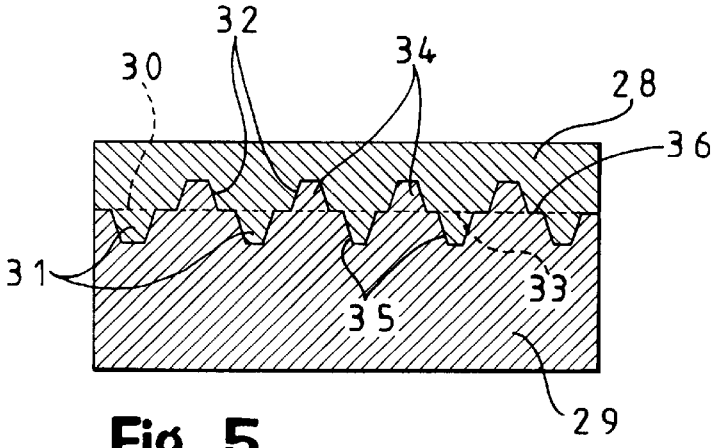
FIG. 5 is diagrammatic cross-section of a preform cutting element in accordance with the present invention.
Figure 6:
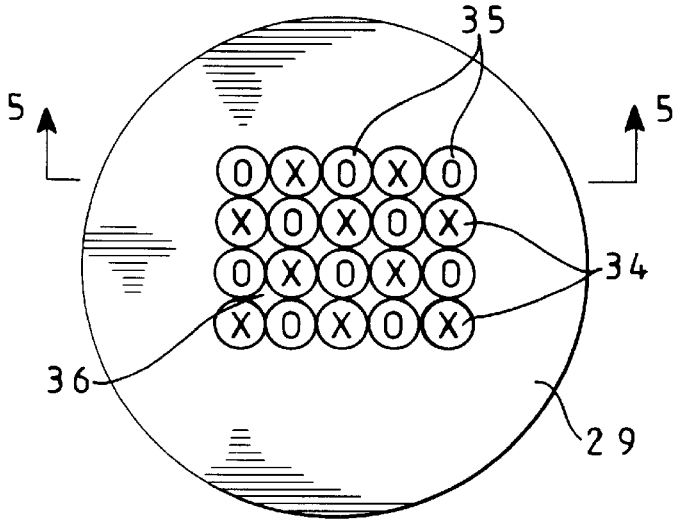
FIG. 6 is a diagrammatic plan view of the substrate of the element of FIG. 5, the facing table having been removed.
Figure 7:
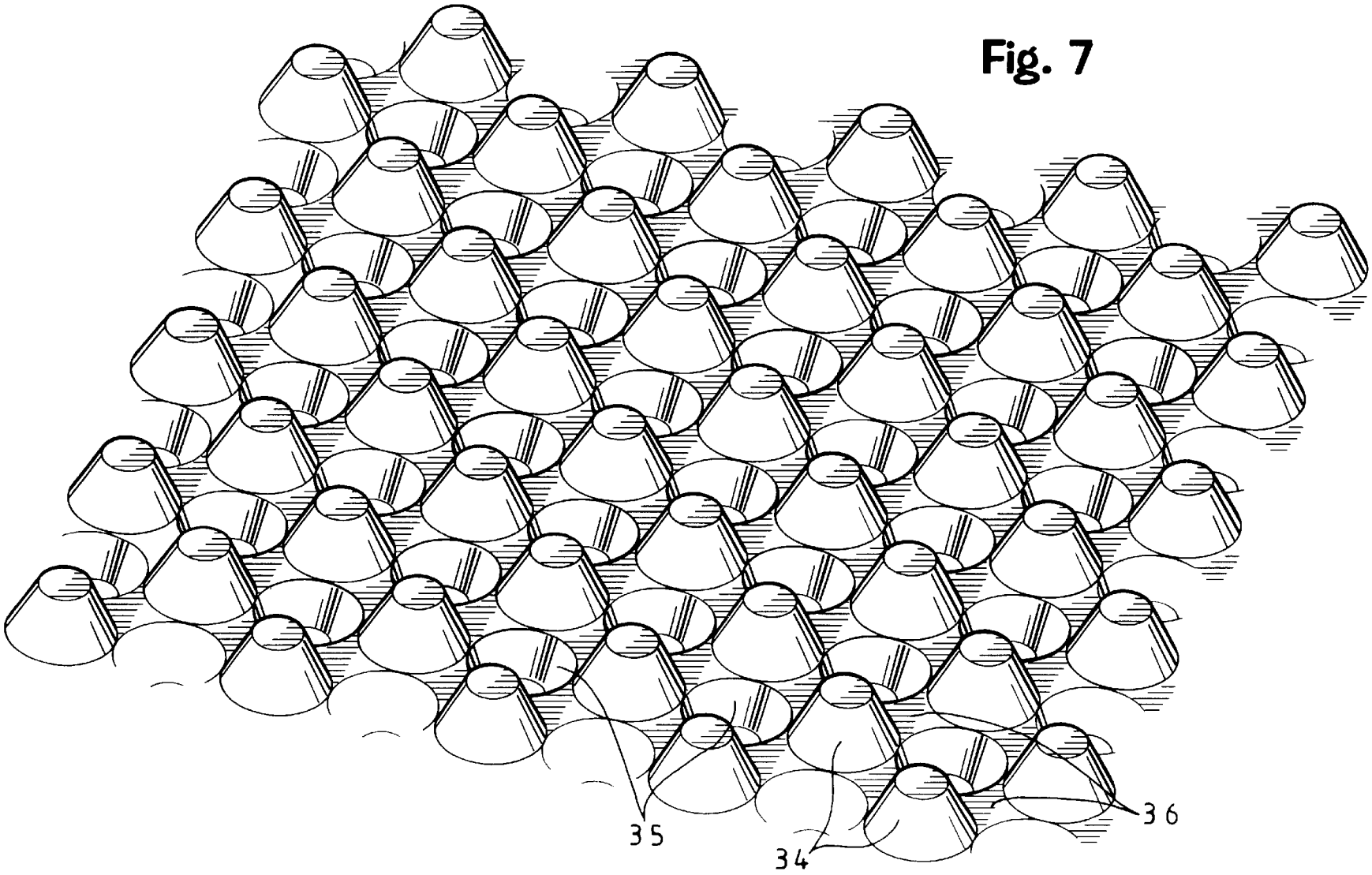
FIG. 7 is a diagrammatic perspective view of the upper surface of the substrate in the arrangement of FIG. 6.

FIGS. 5–7 show diagrammatically a preform cutting element according to the present invention. The cutting element is basically of the same type as the prior art cutters shown in FIGS. 3 and 4, in that it is in the form of a circular tablet comprising a facing table 28 of polycrystalline diamond or other superhard material, bonded to a substrate 29 of tungsten carbide or other suitable material which is less hard than the polycrystalline diamond.

In accordance with the invention, however, the rear face of the facing table 28 comprises a flat surface 30 (shown dotted in FIG. 5) formed with equally spaced frusto-conical protuberances 31 which project downwardly from the surface 30 and a plurality of similarly shaped sockets 32 which extend upwardly into the material of the facing table 28 from the surface 30.

Similarly, the substrate 29 has a front surface 33 which is bonded to the rear surface 30 of the facing table 28, the front surface 33 of the substrate being similarly formed with upward frusto-conical projections 34 and similarly shaped sockets 35 which extend downwardly into the material of the substrate 29.

The protuberances and sockets are of corresponding shapes so that the protuberances 31 on the facing table fit within and are bonded to the sockets 35 on the substrate, and the upward protuberances 34 on the substrate fit within and are bonded to the sockets 32 on the facing table.

FIG. 6 is a diagrammatic plan view of the upper surface of the substrate 29 showing diagrammatically a few of the protuberances and sockets at the upper surface of the substrate. In FIG. 6 the protuberances are marked with an "X" and the sockets are marked with a "0", and this convention will be followed to indicate which are sockets and which are protuberances in the alternative arrangements of FIGS. 8–11.

FIG. 7 is a diagrammatic perspective view on an enlarged scale to show more clearly the configuration of the protuberances and sockets on the upper surface of the substrate 29. It will be seen from FIGS. 6 and 7 that the protuberances 34 are arranged in two sets of parallel rows which are mutually at right angles to one another, and the sockets 31 are similarly arranged, the rows of sockets being co-extensive with the rows of protuberances, so that in each row a protuberance 34 alternates with a socket 31.

In this arrangement, as a result of the frusto-conical shape of the protuberances and sockets, regions 36 of the flat plane 33 are left between the protuberances and sockets. It will be appreciated, however, that the shape and size of these regions will vary according to the shape, size and location of the protuberances and sockets, and arrangements are possible where the regions 36 disappear altogether so that the flat plane becomes an imaginary flat plane which is defined by the location of the base of the protuberances 34 and the mouths of the sockets 35.

In the arrangement shown in FIGS. 5–7, the protuberances and sockets are of constant height and depth. However, in some arrangements the height of the protuberances and depth of the sockets may vary, for example may vary randomly over the area of the cutting element. Also, although the protuberances and sockets on the substrate are shown as being of corresponding shape, this is not essential, and the sockets may be of different shape and size to the protuberances. It will be appreciated that, in such an arrangement, the downward protuberances 31 on the facing table will match the shape and size of the sockets 35 in the substrate while the sockets 32 on the facing table will match the size and shape of the differently shaped protuberances 34.

In practice, the cutting element may be manufactured by preforming one of the facing table and substrate, and preferably the substrate, with the protuberances and sockets on its surface. For example, the substrate may be preformed as a solid body, by molding or machining or by a combination of both processes, with the protuberances and sockets preformed on its upper surface. A layer of particulate polycrystalline diamond material is then applied to the upper surface of the substrate so as to fill the sockets 35 and to extend to a depth greater than the height of the protuberances 34. The substrate with the particulate layer of diamond on it is then subjected to extremely high pressure and temperature, in well known manner, so as to bond the two layers together. Alternatively, one of the facing table or substrate may be pre-moulded from particulate material to give the required configuration of its surface before the addition of the other layer in particulate form.

FIGS. 8–11 show diagrammatically alternative configurations for the protuberances and sockets on the substrate, the configuration of the protuberances and sockets on the facing table being again similar.

Figure 8:
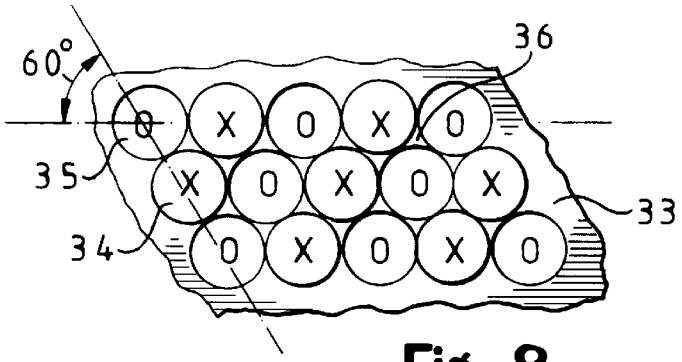

In the arrangement of FIG. 8 adjacent sockets "O" and protuberances "X" are contiguous, as in the arrangement of FIGS. 5–7, but in the arrangement of FIG. 8 adjacent rows are displaced relative to one another so that the protuberances and sockets are close-packed and the size of the intermediate regions 36 of the flat surface 33 of the substrate is a minimum. In this case one set of rows of protuberances and socket extends at 60 to the other set of rows instead of at 90 as in the arrangement of FIGS. 5–7. It will be appreciated, however, that the angle between the two sets of rows might be any intermediate angle between 90 and 45.

Figure 9:
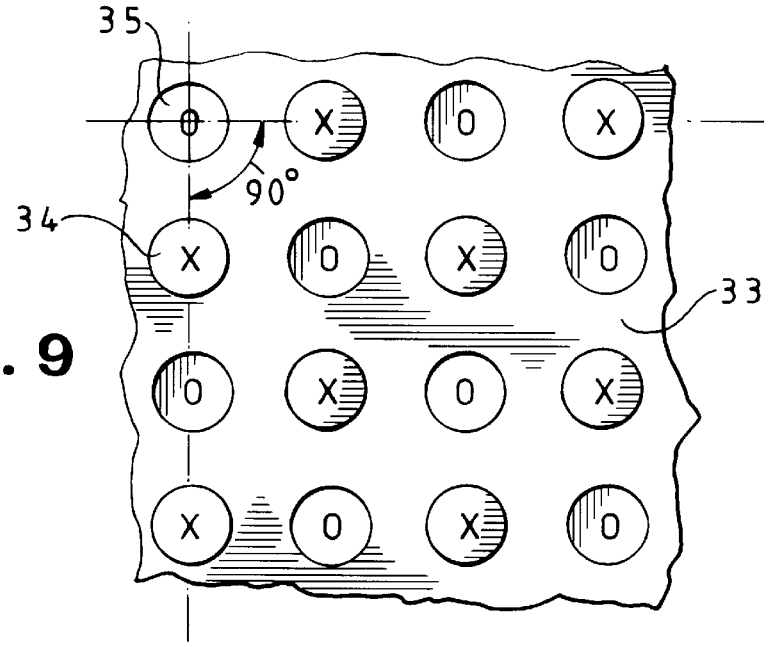
Figure 10:
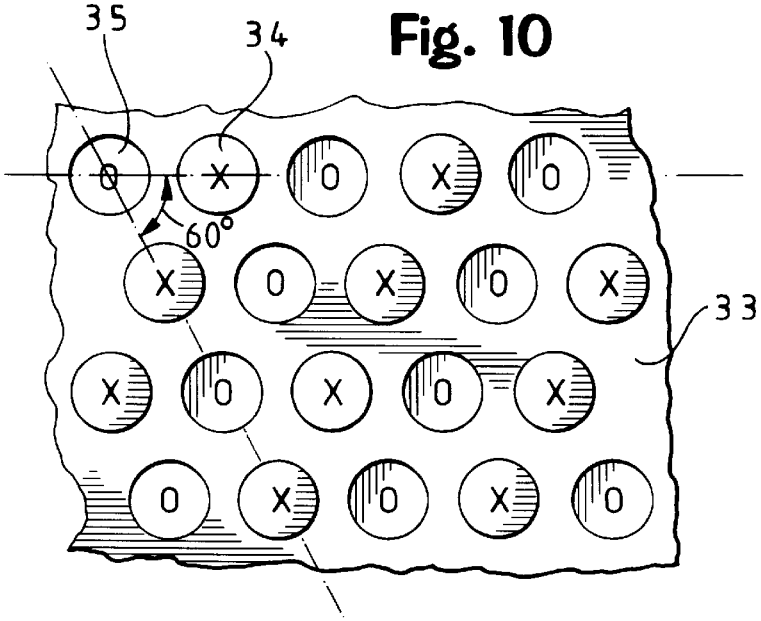

FIG. 9 shows diagrammatically an alternative arrangement where the protuberances "X" and sockets "O" are not contiguous but are spaced apart to expose a continuous larger area of the flat surface 33. In this case the two sets of rows of protuberances and sockets are at right angles, and FIG. 10 shows a modified arrangement where the two sets of rows are arranged at a lesser angle to one another. It will be appreciated that the arrangements of FIGS. 9 and 10 may be varied to achieve any required spacing between the adjacent rows and any angle between the two sets of rows.

In an alternative arrangement, not shown, the protuberances "X" and sockets "O" are arranged in substantially concentric rings which may be centered on the center of the cutting element. Alternate rings of protuberances and sockets may be provided, or each ring may itself comprise protuberances and sockets alternately around the ring.

In another alternative arrangement, the protuberances and sockets may be arranged in rows extending outwardly, for example radially, from the centre, or a central region, of the cutting element. Alternate rows may comprise protuberances and sockets, or each row may itself comprise protuberances and sockets alternating along the length thereof. The outwardly extending rows may be straight or curved.

Although the arrangements described comprise regular arrays of alternating sockets and protuberances, other arrangements are possible. For example, the number of sockets between protuberances in each row may be two or more, and vice versa.

FIG. 11 shows diagrammatically an arrangement where the protuberances "X", the sockets "O" and the exposed regions 36 of the surface 33 of the substrate are all hexagonal in shape. In this case the different components of the face of the substrate are close-packed. It will be appreciated that this principle may be applied to any division of the face of the substrate into close-packed contiguous components where the components are of any shape allowing such close-packing. The components of the face do not require to be all of the same shape and the face may be made up of components of two or more shapes designed to be packed together.

In the arrangements shown the hexagonal regions comprise alternately a socket, a protuberance and a flat region in each row. However such arrangement is by way of example only and any other distribution of the different types of component between the close-packed regions may be employed. The distribution may be regular or irregular.

In the arrangements of FIGS. 5 to 10, the frusto-conical protuberances and sockets are shown merely by way of example and they may be of any other suitable configuration. For example FIG. 12 shows a protuberance in the form of a rectangular truncated pyramid. FIG. 13 shows a protuberance of sinusoidal cross-section and FIG. 14 shows a protuberance in the form of a hexagonal truncated pyramid, suitable for the arrangement of FIG. 11. In each case the socket into which the protuberance is received is of corresponding shape. The socket in the layer from which the protuberance projects may also be of corresponding shape to the protuberance but, as previously mentioned, it might be of different shape.

In the arrangements described above the surfaces 30, 33 are shown as being flat. However, as previously mentioned, the mating surfaces may be curved or may have regular or random fluctuations across the preform element.

In two-layer preform elements one or more transition layers are sometimes disposed between the superhard facing table and the substrate. The transition layer or layers usually have certain critical properties intermediate the corresponding properties of the facing table and substrate so as to reduce stresses at the interface between the two. Suitable materials for such transition layers are described, for example, in U.S. Pat. No. 4,525,178 and European Patent Application No. 93304531.2.

One or more transition layers, for example of the kinds described in the above specifications, may be provided between the facing table and substrate in any of the arrangements according to the present invention. The transition layer may comprise a substantially continuous layer which extends over all the surfaces of the protuberances and sockets on the substrate, as well as the surface regions between them. In this case the transition layer or layers may be of substantially constant thickness. Alternatively, the transition layer may extend only over discrete spaced regions of the interface between the facing table and substrate. For example, a layer of transition material may be applied only over the top surfaces of the protuberances and the bottom surfaces of the sockets. Alternatively or additionally, transition material may be applied only over the remaining regions of the surface on the substraight from which the protuberances and sockets extend.

In relation to preform cutting elements of the basic kind to which this invention relates, i.e. having a superhard facing table bonded to a less hard substrate, it is known that tensile stresses in peripheral regions of the facing table may be reduced by providing a thicker rim around the periphery of the facing table and projecting into the substrate. Such arrangements are shown for example in U.S. Pat. No. 4,861,350 and 5,120,327.

In the known arrangements the thicker rim portions of the facing table are generally angular as viewed in cross-section, for example the thickened rim which projects into the substrate is generally rectangular, triangular, or trapezoidal in cross-section. According to an aspect of the present invention, the tensile stresses in this region of the facing table may be further reduced by providing a thickened rim portion at the rear of the periphery of the facing table which is continuously and smoothly curved in cross-section, for example is in the form of part of a sine wave. Such arrangement is applicable to arrangements of the kind described above, and FIG. 15 shows a modification of the arrangement of FIG. 5 in which there is provided around the periphery of the facing table 28 a thickened peripheral rim portion 37 which projects into the substrate 29. As may be seen from FIG. 15, the inwardly facing surface 38 of the rim 37 is smoothly curved, for example is in the form of part of a sine wave. In the arrangement at the right hand side of FIG. 15 the surface 38 remains curved right up to the outer periphery of the substrate 29. There is shown at the left hand side of FIG. 15 an alternative cross-section where the outer surface 38A of the rim 37A leads to a flat annular portion 39 as it runs towards the outer peripheral surface of the substrate 29.

Generally speaking, in the prior art arrangements the thickened peripheral rim is of constant cross-section as it extends around the periphery of the facing table. The present invention, however, provides arrangements where the cross-sectional shape of the rim varies around the periphery of the facing table.

In the arrangement of FIGS. 16 and 17 the peripheral rim 40 of the facing table 41 varies in thickness periodically as it extends around the periphery of the facing table 41. The upper surface of the substrate 42 is correspondingly shaped. The cross-sectional shape of the rim 40 is generally in the form of part of a sine wave but in this case varies from a minimum thickness indicated at 43, where the cross-section is entirely sinusoidal, to a maximum thickness, indicated at 44, where the lower surface of the rim is formed with a flat portion 45.

FIG. 17 is a view of the rear face of the facing table 41, with the substrate 42 removed, showing the resultant lobed configuration of the peripheral rim 40.

FIGS. 18 and 19 show a modified arrangement where the peripheral rim 46 varies in depth as well as in width, the portions 47 of greater width and depth having a double-curved configuration as best seen in FIG. 18.

The further arrangement shown in FIGS. 20 and 21 is somewhat similar to the arrangement of FIGS. 18 and 19, but in this case the portions 48 of the rim 49 which are of greater width and depth have a cross-section in the form of a single smooth curve.

Such arrangements may substantially reduce the tensile stresses in the facing table when compared with the more angular and symmetrical arrangements of the prior art. The curved rim arrangements described above may also be used with preform elements where the interface between the facing table and substrate inwardly of the rim is flat or is of some other configuration than those according to the first aspects of the present invention.

FIGS. 22–25 show examples of further configuration of interface between the facing table and substrate of a preform cutting element. In this case only the shape of the upper surface of the substrate is shown, but it will be appreciated that the rear surface of the facing table will be of complementary shape. The facing table and substrate may be circular or of any other appropriate shape and one or more transition layers may be disposed between the substrate and facing table if required, as previously described.

Referring to FIGS. 22–24, the tungsten carbide substrate 50 is formed with a generally flat surface 51 across which extend parallel rows of alternating protuberances 52 and sockets 53. The protuberances 52 are generally domed and the sockets 53 are of complementary shape. The protuberances 52 and sockets 53 are asymmetrical as viewed at right angles to the row of protuberances and sockets so that each socket 53 slightly undercuts an adjacent protuberance 52. Thus, when the complementary surface on the facing table is bonded with the surface on the substrate there is a degree of mechanical interlocking between the two faces.

FIG. 25 shows a modified version of the arrangement of FIG. 22 where the protuberances 54 and the sockets 55 are longer so that the extent of undercutting and mechanical interlocking is increased. It will be appreciated that there will be many alternative shapes of protuberances and sockets which will achieve a similar effect.

In the arrangements shown a protuberance in one row lies opposite a protuberance in the adjacent parallel row. However, this is not essential, and each row might be displaced longitudinally with respect to the adjacent row. For example, the displacement may be such that each protuberance in one row lies opposite a socket in the adjacent row.

Also, the protuberances and sockets in some rows, for example alternate rows, might be inclined in the opposite direction from that shown so as to increase the mechanical interlock between the facing table and substrate.

The facing table may also be formed with one or more other protuberances, such as elongate ribs, which are not arranged according to the present invention.

Figure 26:
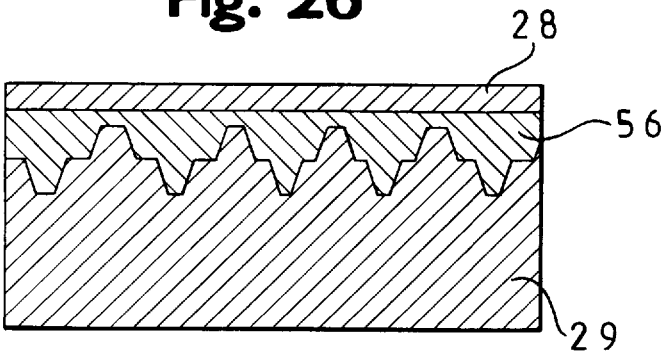
FIGS. 26 to 28 show modifications of the cutting element of FIG. 5.
Figure 27:
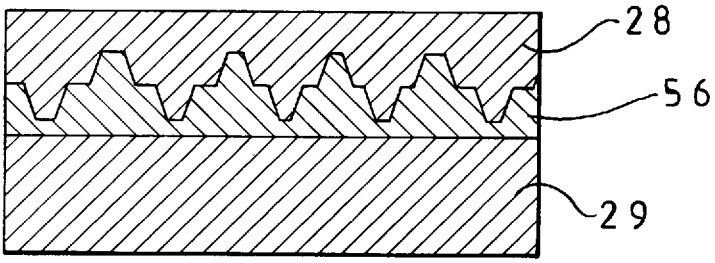
Figure 28:
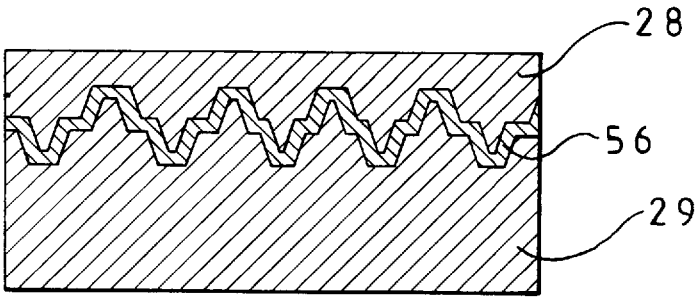

In any of the above arrangements a transition layer may be provided between the superhard material of the facing table 28 and the less hard material of the substrate 29. In the case where the protuberances and sockets are formed at the interface between the rear surface of the superhard material and the transition layer, the transition layer may be regarded as forming part of the substrate. Conversely, the protuberances and sockets may be formed at the interface between the transition layer and the substrate 29, in which case the transition layer may be regarded as forming part of the facing table. In either case, the interface between facing table or substrate and the transition layer which is not formed with protuberances and sockets in accordance with the present invention may be planar, or may be otherwise configured to provide a non-planar interface. Alternatively, both interfaces may be formed with protuberances and sockets arranged in accordance with the present invention. FIGS. 26 to 28 show modifications of the cutting element of FIG. 5 in which a transition layer 56 is provided. In FIG. 26 the transition layer may be regarded as forming part of the facing table, whereas in FIG. 27 the transition layer may be regarded as forming part of the substrate. In FIG. 28, where both surfaces of the transition layer are configured according to the invention, the layer may be regarded either as forming part of the facing table or as forming part of the substrate.

Whereas the present invention has been described in particular relation to the drawings attached hereto, it should be understood that other and further modifications, apart from those shown or suggested herein, may be made within the scope and spirit of the present invention.

What is claimed:

1. A preform element including a facing table of superhard material having a front face and a rear face bonded to the front face of a substrate which is less hard than the superhard material, the rear face of the facing table comprising a surface formed with a plurality of spaced protuberances and a plurality of spaced sockets, and the front face of the substrate comprising a surface which is bonded to the surface of the facing table and is formed with a plurality of spaced protuberances which are bonded within said sockets in the facing table, and a plurality of spaced sockets within which are bonded said protuberances on the facing table.

2. A preform element according to claim 1, wherein the surfaces formed with said protuberances and sockets are both substantially flat, apart from said protuberances and sockets.

3. A preform element according to claim 1, wherein the surfaces formed with said protuberances and sockets comprise a convexly curved surface, on one of the facing table and substrate, bonded to a mating concavely curved surface on the other of the facing table and substrate.

4. A preform element according to claim 1, wherein the surfaces have regular or random fluctuations across the preform element.

5. A preform element according to claim 1, wherein the location of each said surface is largely defined by the locations of the mouths of the sockets and the bases of the protuberances which extend from the surface, the physical manifestation of the surface comprising small areas of the surface between said sockets and protuberances.

6. A preform element according to claim 1, wherein the individual protuberances and sockets are tapered as they extend away from said surface.

7. A preform element according to claim 1, wherein the protuberances and sockets are circular, square or hexagonal in cross-section.

8. A preform element according to claim 6, wherein each protuberance and socket is generally frusto-conical or in the shape of a square or triangular pyramid, or a truncated square or triangular pyramid.

9. A preform element according to claim 1, wherein the protuberances and sockets are of substantially constant height over the facing table and substrate.

10. A preform element according to claim 1, wherein the protuberances and sockets vary in height.

11. A preform element according to claim 10, wherein the extremities of the protuberances and sockets lie on an imaginary surface within the facing table or substrate.

12. A preform element according to claim 11, wherein the imaginary surface is substantially flat or is convexly or concavely curved.

13. A preform element according to claim 1, wherein the depths of the protuberances and sockets vary irregularly across the facing table or substrate.

14. A preformn element comprising:

a facing table having a front face and a rear face, the rear face of the facing table having a plurality of spaced protuberances and a plurality of spaced sockets, the plurality of spaced protuberances and the plurality of spaced sockets being arranged in substantially regular arrays; and a substrate being softer than the facing table and having a front face and a rear face, the front face of the substrate having a plurality of spaced protuberances which are bonded within the sockets in the facing table and a plurality of spaced sockets within which are bonded the protuberances on the facing table.

15. A preform element according to claim 14, wherein the protuberances and sockets are arranged in substantially concentric rings.

16. A preform element according to claim 14, wherein the protuberances and sockets are arranged in rows extending outwardly from a central region of the element.

17. A preform element comprising:

a facing table having a front face and a rear face, the rear face of the facing table having a plurality of spaced protuberances and a plurality of spaced sockets, the plurality of spaced protuberances and the plurality of spaced sockets being arranged in substantially parallel rows; and a substrate being softer than the facing table and having a front face and a rear face, the front face of the substrate having a plurality of spaced protuberances which are bonded within the sockets in the facing table and a plurality of spaced sockets within which are bonded the protuberances on the facing table.

18. A preform element according to claim 17, wherein each row of protuberances is co-extensive with a row of sockets so that at least some of the sockets are located in the spaces between adjacent protuberances, and vice versa.

19. A preform element according to claim 18, wherein the protuberances and sockets are arranged alternately along each row.

20. A preform element according to claim 17, wherein the protuberances and sockets are arranged in two sets of parallel rows, each set being at right angles to the other.

21. A preform element according to claim 17, wherein the protuberances and sockets are arranged in two sets of parallel rows, each set being inclined to the other at an angle which is less than a right angle.

22. A preformn element comprising:

a facing table having a front face and a rear face, the rear face of the facing table having a plurality of spaced protuberances and a plurality of spaced sockets; and a substrate being softer than the facing table and having a front face and a rear face, the front face of the substrate having a plurality of spaced protuberances which are bonded within the sockets in the facing table and a plurality of spaced sockets within which are bonded the protuberances on the facing table, wherein each said protuberance and socket, as viewed in longitudinal cross-section, is in the shape of a portion of a generally sinusoidal curve.

23. A preform element comprising:

a facing table having a front face and a rear face, the rear face of the facing table having a surface having a plurality of spaced protuberances and a plurality of spaced sockets; and a substrate being softer than the facing table and having a front face and a rear face, the front face of the substrate having a surface having a plurality of spaced protuberances which are bonded within the sockets in the facing table and a plurality of spaced sockets within which are bonded the protuberances on the facing table, wherein at least certain of the protuberances and sockets are inclined at less than a right angle to the surfaces on which they are formed to provide a mechanical interlock between the surfaces.

24. A preform element comprising:

a facing table having a front face and a rear face, the rear face of the facing table having a surface having a plurality of spaced protuberances and a plurality of spaced sockets; and a substrate having a front face and a rear face, the front face of the substrate having a surface having a plurality of spaced protuberances which are bonded within the sockets in the facing table and a plurality of spaced sockets within which are bonded the protuberances on the facing table, wherein the facing table includes a transition layer having a rear face which constitutes the surface of the rear face of the facing table which is formed with the protuberances and sockets which are bonded with the sockets and protuberances on the front face of the substrate.

25. A preform element comprising:

a facing table having a front face and a rear face, the rear face of the facing table having a surface having a plurality of spaced protuberances and a plurality of spaced sockets; and a substrate having a front face and a rear face, the front face of the substrate having a surface having a plurality of spaced protuberances which are bonded within the sockets in the facing table and a plurality of spaced sockets within which are bonded the protuberances on the facing table, wherein the substrate includes a transition layer having a front face which constitutes the surface of the front face of the substrate which is formed with the protuberances and sockets which are bonded with the sockets and protuberances on the rear face of the facing table.

26. A preform element comprising:

a facing table having a front face and a rear face, the rear face of the facing table having a plurality of spaced protuberances and a plurality of spaced sockets; and a substrate being softer than the facing table and having a front face and a rear face, the front face of the substrate having a plurality of spaced protuberances which are bonded within the sockets in the facing table and a plurality of spaced sockets within which are bonded the protuberances on the facing table, wherein the facing table is formed with a thickened peripheral rim which projects into the substrate.

27. A preform element according to claim 26, wherein the peripheral rim is smoothly curved as viewed in cross-section.

28. A preform element according to claim 27, wherein the peripheral rim is sinusoidally curved as viewed in cross-section.

29. A preform element according to claim 26, wherein the thickened peripheral rim varies in width and/or depth as it extends around the periphery of the facing table.

30. A drill bit comprising:

a bit body;

a cutting element coupled to the bit body, the cutting element comprising:

a facing table made of a superhard material and having a front face and a rear face, the rear face of the facing table having a plurality of spaced protuberances and a plurality of spaced sockets; and a substrate made of a material softer than the facing table and having a front face and a rear face, the front face of the substrate having a plurality of spaced protuberances which are disposed within the sockets in the facing table and a plurality of spaced sockets within which are disposed the protuberances on the facing table.

31. A drill bit comprising:

a bit body;

a cutting element coupled to the bit body, the cutting element comprising:

a facing table having a front face and a rear face, the rear face of the facing table having a plurality of spaced protuberances and a plurality of spaced sockets; and a substrate having a front face and a rear face, the front face of the substrate having a plurality of spaced protuberances which are bonded within the sockets in the facing table and a plurality of spaced sockets within which are bonded the protuberances on the facing table, wherein each said protuberance and socket, as viewed in longitudinal cross-section, is in the shape of a portion of a generally sinusoidal curve.

32. A drill bit comprising:

a bit body;

a cutting element coupled to the bit body, the cutting element comprising:

a facing table having a front face and a rear face, the rear face of the facing table having a plurality of spaced protuberances and a plurality of spaced sockets; and a substrate having a front face and a rear face, the front face of the substrate having a plurality of spaced protuberances which are bonded within the sockets in the facing table and a plurality of spaced sockets within which are bonded the protuberances on the facing table, wherein the facing table is formed with a thickened peripheral rim which projects into the substrate.

33. A cutting element comprising:

a facing table having a front face and a rear face, the rear face of the facing table having a plurality of spaced protuberances and a plurality of spaced sockets; and a substrate being softer than the facing table and having a front face and a rear face, the front face of the substrate having a plurality of spaced protuberances which are bonded within the sockets in the facing table and a plurality of spaced sockets within which are bonded the protuberances on the facing table.

* * * * *